United States Patent [19]

Mason

[11] 4,096,598

[45] Jun. 27, 1978

[54] SELECTED DEPTH MOORING SYSTEM

[76] Inventor: Russell I. Mason, 30 Kensington Rd., Glen Falls, N.Y. 12801

[21] Appl. No.: 779,740

[22] Filed: Mar. 21, 1977

[51] Int. Cl.[2] ..... B63B 21/52

[52] U.S. Cl. ..... 9/8 R; 114/16.5

[58] Field of Search ..... 9/8 R, 8.3 E, 8.3 R, 9/9; 114/16.5, 16.7

[56] References Cited

U.S. PATENT DOCUMENTS 3,631,550 1/1972 Bullen ..... 9/8 R

*Primary Examiner*—Trygve M. Blix
*Assistant Examiner*—D. W. Keen

[57] ABSTRACT

A selected depth mooring system, such as a sensor package or mine, deployable to and maintainable at a precise depth relative to the surface. A cylindrical housing of flotation, submersible and anchor units connected in tandem are sequentially separated and deployed by cable from the surface to moor the submersible unit the desired depth from the anchor unit, and to release the flotation unit after deployment.

10 Claims, 3 Drawing Figures

SELECTED DEPTH MOORING SYSTEM

BACKGROUND OF THE INVENTION

It is frequently desired to maintain a submerged device, such as a mine or a sensor package, at a precise depth beneath the surface of the water. Suspending it from a surface float is not always possible or desirable. Covert use is defeated because the float can be seen or detected. Precise depth control is not possible in sea areas where there is a large water current causing the suspension cable to slope unpredictably.

A moored buoy is therefore more desirable, there being no float on the surface to create drift, to permit visible detection, or to cause stress due to wave action.

Various methods and apparatus have been used or suggested for mooring a submerged device at a selected depth. But a problem arises from the fact that the bottom of the sea is uneven and requires mooring cables all of different lengths. This problem is usually solved by first measuring the total depth to the bottom and then manually setting the mooring cable lengths. Automatic systems for selecting precise depths use more complex and expensive hydrostatic pressure sensitive mechanisims. The manual method is time-consuming, and may still be unprecise because the actual mooring spot on the bottom may not be the same spot at which the measurement was made. The automatic systems entail more careful handling and are subject to more failures.

SUMMARY OF THE INVENTION

Accordingly, it is a general purpose and object of the present invention to provide a mooring system for automatically selecting and maintaining a submersible unit at a relatively precise depth.

Another object of the invention is to provide a mooring cable length irrespective of total depth to the bottom of the water, while maintaining a precise depth for the moored device.

Still another object of the invention is to provide a mooring system which removes all the aforementioned disadvantages of floating buoys while retaining simplicity of mechanization and operation.

A still further object of the invention is to provide a selected depth mooring system which is inexpensive to manufacture and simple to use.

Briefly, these and other purposes and objects are achieved according to the invention by a moored system having three separable sections sequentially deployable when dropped into the sea. A first section or flotation unit separates first at the surface while the other sections drop to the desired mooring depths determined by the length of a first or upper cable connected there between. Then a second section or submersible unit separates while a remaining third section or anchor unit continues to drop to the bottom. A second or lower cable connected between the submersible unit and the anchor unit then locks against further payout, and the flotation unit and paid out upper cable releases from the submersible unit. The weights and buoyant forces of the three sections and the two cables are selected to ensure submergence of the two lower sections, while the flotation unit remains at the surface, but which will ensure that the submersible unit remains buoyant after the flotation unit and upper cable are released.

Other purposes, objects, advantages and novel features of the invention will become apparent from the following detailed description of the invention when considered in conjunction with the accompanying drawing wherein:

DESCRIPTION OF THE PREFERRED EMBODIMENT

Figure 1:
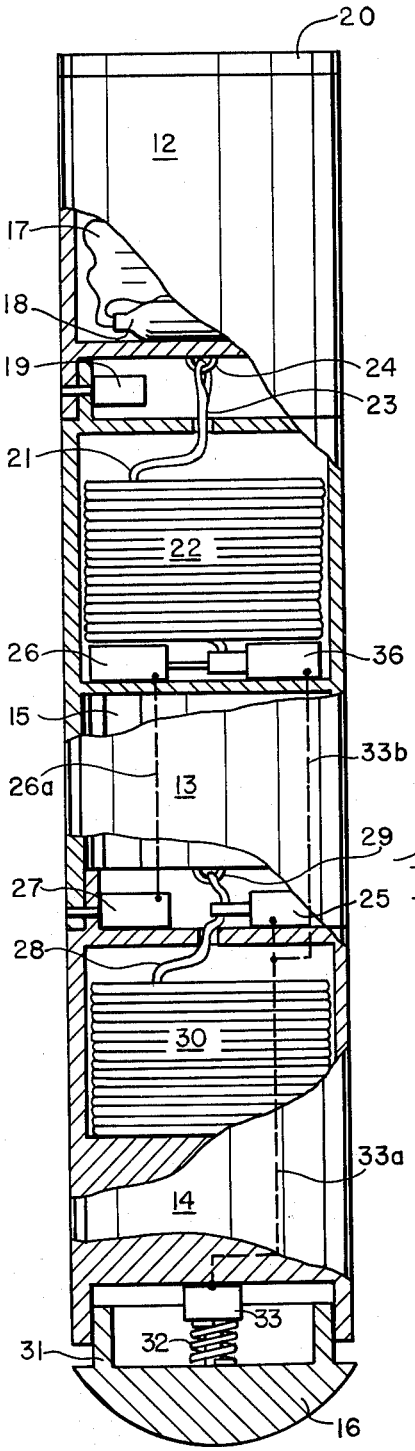
FIG. 1 represents a longitudinal and fragmented view of a selected depth mooring system constituted according to a preferred embodiment of the invention.

Referring now to FIG. 1, there is shown a selected depth mooring system having three cylindrical and separable sections coaxially connected in tandem to form a singular cylinder. The sections consist of a flotation unit 12, a submersible unit 13 and an anchor unit 14. The submersible unit 13 contains a package 15 which is required to be moored at a relatively precise location and depth when fully deployed from the units 12 and 14.

The cylindrical ends of flotation unit 12 and submersible unit 13 slidably mesh with each other and are releasably held in place by a conventional squib-activated plunger 19 fired on exposure to water. By conventional means not shown, a folded bag 17 in flotation unit 17 is inflated by a pressurized gas cartridge 18 when the units 12 and 13 are separated. This forces and end cap 20 off and allows bag 17 to fully expand for the desired buoyancy. Of course, it is understood that the bag 17 may not be required where sufficient buoyancy can be obtained from a sealed container. The manner in which the relative weights and buoyances are determined are explained hereinafter.

The submersible unit 13 contains a spool of cable 22 with one end 21 connected to a fitting 24 on flotation unit 12. The other end of cable 22 passes through a selectable-length cable cutter 36 to a tension-responsive electric switch 26 fixed within submersible unit 13. At the desired payout length, cable 22 applies a tensile force to switch 26 completing an electric circuit **26*a* to a conventional squib-activated plunger 27 which releasably holds in place the cylindrical ends of submersible unit 13 and anchor unit 14** which are in slidable mesh with each other.

The anchor unit 14 contains a spool of cable 30 with one end 28 passing through an electrically-operated cable lock 25 and connects to a fitting 29 on package 15. The other end of the cable 30 is connected to anchor unit 14. The total length of cable 30 in the anchor unit 14 is at least as long as the remaining depth from the submersible unit 13 to the bottom of the sea. The distal end of anchor unit 14 defines a slidable plunger 16 which is urged outward by the spring 32 from an electrical switch 33. When unit 14 hits bottom during its deployment, plunger 16 is urged against switch 33 completing an electric circuit **33*a*, preferably in cable 30, to cable lock 25 and cable cutter 36 in submersible unit 13. This releases cable 22 and flotation unit 12 and prevents cable 30** from further payout.

It is contemplated that appropriate electrical and mechanical interlocks, not shown, may be used as desired to prevent operations inconsistant with the sequence described herein.

It is essential to the operability of the present invention that the weights and buoyancies of the respective units 12, 13 and 14 and cables 22 and 30 be selected to ensure proper deployment. That is, the flotation unit 12 should have a buoyancy greater than the combined weight in water of the unseparated units 13 and 14 and cables 22 and 30. This will ensure that flotation unit 12 remains on the surface as cable 22 pays out to the desired depth. The unit 13 must be buoyant, but exclusive of the paid out portion of cable 22, it should be less than the contrived weight in water of the anchor unit 14 and cable 30. This will ensure that submersible unit 13 remains at the desired depth after flotation unit 12 and paid out cable 22 are released.

Figure 3:
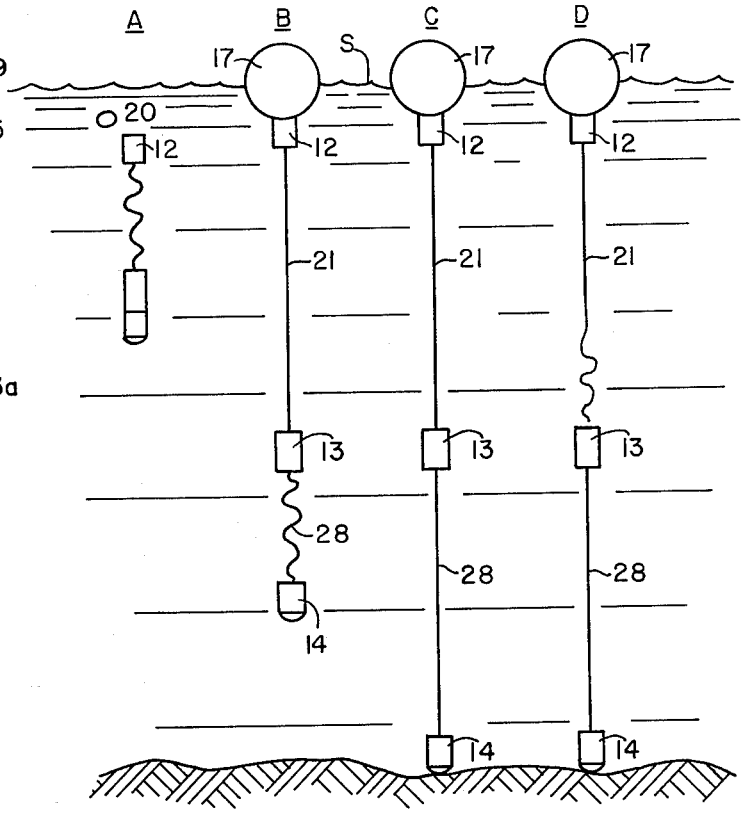
FIG. 3 is a schematic elevation view of a sea area in which the embodiment of FIG. 1 is shown in four stages of deployment.

The sequence of deployment at the selected depth mooring system of the present invention is summarized with reference to FIG. 3. The dimensions, weights, etc. are only illustrative and do not limit the scope of the invention. The cable 22 has a pre-selected payout length of 500 feet, and cable 30 has a total length of 300 feet. Flotation unit 12 with bag 17 inflated has a positive buoyancy of 500 lbs, submersible unit 13 has a positive buoyancy of 25 lbs., payout cable 22 has a negative buoyancy of 50 lbs., and anchor unit 14 and cable 30 have negative buoyancies of 50 and 10 lbs., respectively. The system at stage A is dropped into the water causing water-activated plunger 19 to release the flotation unit 12. There being an initial tension of 85 lbs. on cable 21, it begins to payout as the other units descend and bag 17 inflates. At stage B, the cable 21 has reached the selected payout depth of 500 feet corresponding to the desired mooring depth of submersible unit 13. This produces a 35 lb. tensile force on switch 26, which releases anchor unit 14, and permits cable 28 to payout under a tensile force of 25 lbs. At stage C, anchor unit 14 has reached the bottom at a total depth of 700 feet; and at stage D, the 50 lb. force of unit 14 moves plunger 16 against switch 33 causing the cable 28 to lock and the paid out cable 21 to be severed at the submersible unit 13 by lock 25 and cutter 39, respectively. Submersible unit 13 at the desired depth now maintains cable 30 taut with a positively buoyancy of 25 lbs. against negative buoyancies of 10 and 50 lbs. of the cable 30 and anchor unit 14, respectively.

It is further contemplated that conventional means may be used to scuttle the flotation unit 12 after its usefulness has ended.

Figure 2:
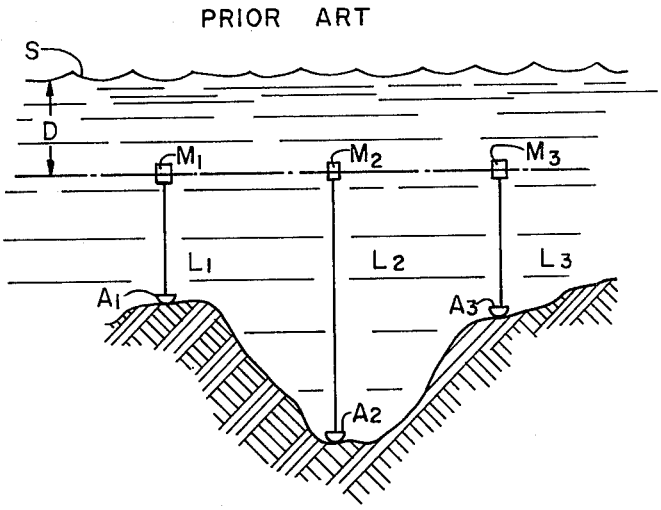
FIG. 2 is an elevation view of a sea area in which several conventional moored buoys are anchored on an uneven bottom.

Some of the many advantages and novel features of the invention should now be apparent. Referring to FIG. 2, for example, the variations in bottom elevation at anchors $A_1$, $A_2$ and $A_3$ of conventional mooring systems $M_1$, $M_3$ and $M_4$ require taut line cables of differing lengths $L_1$, $L_2$ and $L_3$ in order to maintain a constant mooring depth D from the water surface S. The mooring depth is fixed in the present invention by the selected payout length of cable 22 and the amount of cable 30 paid out will vary with the bottom elevation of the sea. The system is particularly suited for covert operations, swift ocean currents and high vertical velocity gradients above the submersible unit. The simplified construction and use of conventional components manifests ease of manufacture, maintenance and repair.

Of course, it will be understood by those skilled in the art that many variations and modifications of the invention may be made by those skilled in the art without departing from the spirit and scope of the invention as herein described and claimed.

I claim:

1. A selected depth mooring system for use at sea of any bottom depth, comprising, in combination:

flotation means deployable on the surface of the sea;

mooring means including buoyant submersible means releasably coupled to said flotation means and deployable to a selected depth relative to the surface, anchor means releasably coupled to said submersible means and deployable to the bottom of the sea, first cable means operatively connected between said submersible means and said anchor means for payout to a length equal to the distance from the selected depth to the bottom, the combined weight in water of said anchor means and said first cable means being greater than the buoyant force of said submersible means; and second cable means operatively connected between said flotation means and said mooring means for payout to a length equal to the selected depth, the combined weight in water of said mooring means and said second cable means being less than the buoyant force of said flotation means.

2. A selected depth mooring system according to claim 1 further comprising:

first decoupling means operable when said second cable is paid out to the selected depth for releasing said anchor means from said submersible means.

3. A selected depth mooring system according to claim 2 further comprising:

locking means operable when said anchor means reaches bottom for preventing further payout of said first cable.

4. A selected depth mooring system according to claim 3 further comprising:

second decoupling means operable when said anchor means reaches bottom for releasing said second cable means and said flotation means from said submersible means.

5. A selected depth mooring system according to claim 4 further comprising:

third decoupling means operable when said system is immersed in the sea for releasing said mooring means from said flotation means.

6. A mooring system for establishing and maintaining a device at a preselected depth, comprising, in combination:

a flotation unit;

a buoyant submersible housing formed to contain the device releasably connected to said flotation unit;

an upper cable within said housing connected at its ends to said unit and said housing and having a payout length corresponding to the preselected depth;

first release means responsive to initial deployment for decoupling said housing from said unit permitting said housing to descend for the length of said upper cable;

an anchor releasably connected to said housing;

a lower cable within said anchor connected at its ends to said housing and said anchor and having a payout length corresponding at least to the distance from the preselected depth to the bottom;

second release means responsive to total payout of said upper cable for decoupling said anchor from said housing;

locking means responsive to said anchor reaching bottom for preventing further payout of said lower cable; and third release means responsive to said anchor reaching bottom for decoupling said upper cable from said housing.

7. A method of lauching a buoyant submersible device to a selected depth at sea comprising the steps of:

dropping a float onto the surface of the sea;

paying out a first cable attached between the float and the device to the selected depth;

paying out a second cable attached between the device and an anchor until the anchor reaches the bottom; and locking the second cable from further payout.

8. A method according to claim 7 further comprising the step of:

releasing the first cable and float from the device.

9. A selected depth mooring system for use in water of any bottom depth, comprising:

cable means including first and second sections compactly stored for payout and having a total payout length greater than the bottom depth with said first section payout length equal to the selected depth;

flotation means deployable on the surface of the water attached to one end of said cable means for remaining on the surface as said cable means pays out;

sinker means deployable to the bottom and attached to the other end of said cable means for paying out said first section in full and said second section until said sinker means reaches the bottom;

locking means operatively connected to said cable means for preventing further payout of said second section when said sinker means reaches the bottom; and submersible means operatively connected to said cable means for mooring said second section from the bottom to the selected depth.

10. A selected depth mooring system according to claim 9 further comprising:

decoupling means operable when said sinker means reaches the bottom for releasing said flotation means and the first section of said cable means.

* * * * *